US012359876B1

(12) United States Patent
Allison

(10) Patent No.: US 12,359,876 B1
(45) Date of Patent: Jul. 15, 2025

(54) GROUND TESTABLE SPACECRAFT HEAT PIPE

(71) Applicant: Government of the United States as represented by the Secretary of the Air Force, Kirtland AFB, NM (US)

(72) Inventor: Jonathan Allison, Albuquerque, NM (US)

(73) Assignee: Government of the United States as represented by the Secretary of the Air Force, Kirtland AFB, NM (US)

( * ) Notice: Subject to any disclaimer, the term of this patent is extended or adjusted under 35 U.S.C. 154(b) by 4 days.

(21) Appl. No.: 18/116,292

(22) Filed: Mar. 1, 2023

(51) Int. Cl.
*F28D 15/02* (2006.01)
*F28D 15/04* (2006.01)
*F28D 21/00* (2006.01)

(52) U.S. Cl.
CPC ..... *F28D 15/0266* (2013.01); *F28D 15/04* (2013.01); *F28D 2015/0216* (2013.01); *F28D 2021/0021* (2013.01)

(58) Field of Classification Search
CPC ..... F28D 15/0266; F28D 15/04; F28D 2015/0216; F28D 2021/0021
See application file for complete search history.

(56) References Cited

U.S. PATENT DOCUMENTS 1,609,334 A 12/1926 Von Platen et al.
1,781,541 A 11/1930 Einstein et al.
5,351,488 A 9/1994 Sorensen
2003/0051857 A1* 3/2003 Cluzet ..... F28D 15/043 165/41
2003/0159808 A1* 8/2003 Hoang ..... F28D 15/043 165/104.24

(Continued)

FOREIGN PATENT DOCUMENTS

CN 105674780 B * 12/2017
EP 2940416 A1 * 11/2015 ..... F28D 15/04
WO WO-2006072244 A1 * 7/2006 ..... F28D 15/0266

OTHER PUBLICATIONS

J. Aman et al., Modelling and Analysis of Bubble Pump Parameters for Vapor Absorption Refrigeration Systems, ASHRAE Annual Conference, Jun. 25, 2016, pp. 1-9, The American Society of Heating Refrigerating and Air-Conditioning Engineers, Peachtree Corners GA, USA.

(Continued)

*Primary Examiner* — Tho V Duong
(74) *Attorney, Agent, or Firm* — AFNWC/JA; David L. Narciso

(57) ABSTRACT

A ground testable spacecraft heat pipe has a spacecraft heat pipe thermally connected for conduction of heat through a heat acquisition cold plate to a heat acquisition riser of a bubble pump heat pipe, enabling a plug-slug flow of heated fluid into a separator, with heated liquid flowing downward through a hear rejection downcomer to a heat rejection pipe section mounted on a heat rejection cold plate for conduction of heat to a bottom end of the spacecraft heat pipe, the now-cooled liquid flowing through a heat rejection riser to an outlet in a condenser that receives the heated vapor from the separator through a vapor condensation conduit, the condenser holding the cooled fluid and vapor condensate that exits the condenser through a heat acquisition downcomer to restart the cycle.

14 Claims, 4 Drawing Sheets

(56) References Cited

U.S. PATENT DOCUMENTS

| | | | | |
|---|---|---|---|---|
| 2013/0306278 | A1* | 11/2013 | Hoang | F28D 15/043 165/104.26 |
| 2016/0332506 | A1* | 11/2016 | Rubitschek | B60H 1/20 |
| 2018/0031330 | A1* | 2/2018 | Roberts | F28D 15/046 |

OTHER PUBLICATIONS

Sy-Chi Kyo, Bubble pump in a closed-loop system for electronic cooling, Applied Thermal engineering, Mar. 2013, pp. 425-434, vol. 51 Issue 1-2, Elsevier Science Ltd., London UK.

* cited by examiner

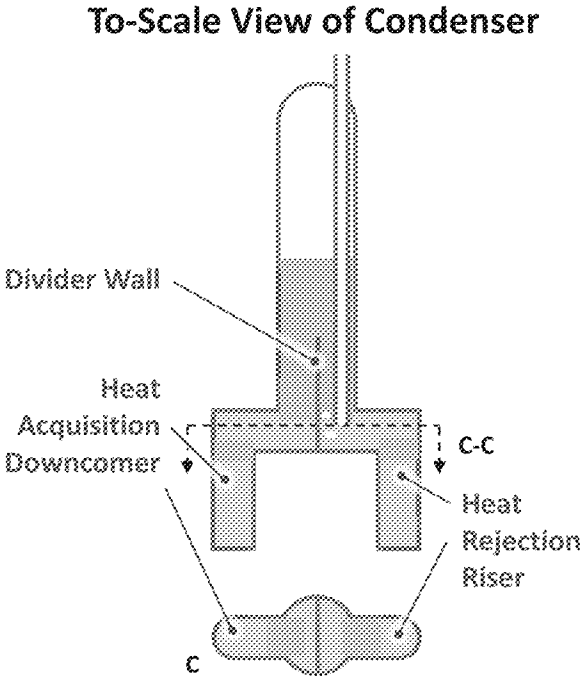
Fig. 3C
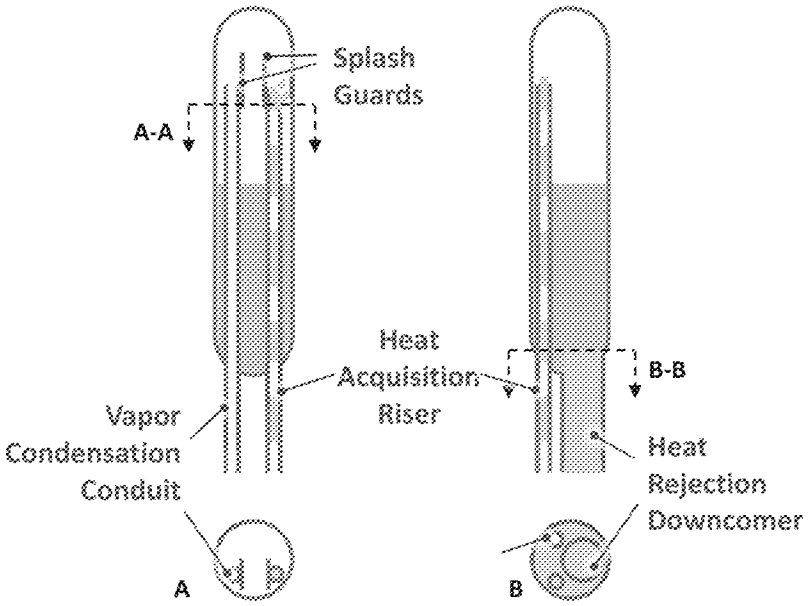
Fig. 3B
Fig. 3A

GROUND TESTABLE SPACECRAFT HEAT PIPE

RIGHTS OF THE GOVERNMENT

The invention described herein was made by an employee of the United States Government and may be manufactured and used by or for the Government of the United States for all governmental purposes without the payment of any royalty.

Pursuant to 37 C.F.R. § 1.78 (a) (4), this application claims the benefit of and priority to prior filed co-pending Provisional Application Ser. No. 63/315,425, filed Mar. 1, 2022, which is expressly incorporated herein by reference.

FIELD OF THE INVENTION

The present invention relates generally to heat pipes and, more particularly, to a heat pipe system for carrying heat downward enabling ground testing of a spacecraft heat pipe.

BACKGROUND OF THE INVENTION

Simple spacecraft heat pipes have no body forces (no gravity) in their nominal operation environment (freefall in space). On the ground, if the heat pipe is oriented such that some part of the heat pipe axis has a component normal to the direction of gravity, the liquid in the heat pipe will tend to puddle at the bottom of the heat pipe. The grooved capillary wick in typical spacecraft heat pipes is typically only able to wick a small fraction of an inch against gravity so the grooves above the liquid puddle are dry. If heat is applied to the liquid puddle, liquid in the puddle can boil or evaporate and move up the height of the pipe buoyantly. When the vapor condenses on the walls of the heat pipe it is dragged down the grooves via gravity. This is called 'reflux operation' and it is essentially using the heat pipe as a thermosyphon (another type of 2-phase heat transfer device; a thermosyphon relies on gravity to return the liquid to the evaporator). Reflux operation works fine for ground testing of spacecraft heat pipes, but it is only suited for test configurations where heat must be carried up. However, there are situations and configurations where carrying heat down is required in order to test the spacecraft heat pipe. Three common situations where heat is input are (1) a heat generating payload is on a mast and its radiator is beneath it, (2) Low Noise Amplifiers (LNAs) are mounted near receive feeds for purposes of gain but this locates them above their thermal radiators, and (3) Vertically oriented heat pipes on thermal radiators may have some test configurations where most heat is above the liquid pool of the heat pipe, making reflux operation impossible.

Currently available options to deal with the need to carry heat down during a spacecraft thermal ground test have associated issues and can impose significant costs and risks. Avoiding Top-Heating consumes resources (size, weight, real estate, schedule, design team's personnel, money) is not always possible due to resource constraints. Turning the spacecraft to a different orientation during ground tests can get the offending heat pipes flat relative to gravity and is attractive to a Thermal engineer, but unattractive to many others, as it often requires using a larger vacuum chamber (schedule and money impacts), it drives costs for spacecraft thermal vacuum (SCTV) test design, and there are often heat pipes running in all 3 axes, so no orientation is perfect. Applying heat to the bottom of the offending heat pipes for test purposes drives heat pipes and connected hardware to higher operating temperature, is a more difficult thermal test, is not strictly Test-as-you-Fly (TAYF) (TAYF is important for managing risk), and is not always possible, depending on needs. Using a ground support equipment (GSE) pumped fluid loop (PFL) to drive heat in and out of the offending heat pipe to force it into reflux requires removal and rework of thermo-optical surface of the thermal radiator, is not strictly Test-as-you-Fly (TAYF), the test setup is somewhat expensive, and requires good access which is, importantly, not always available. Finally, using an alternative thermal control technology such as a PFL or Loop Heat Pipe (LHP) greatly increases costs, greatly increases risk of failure, and is a poor choice since the test design is driving operational design.

SUMMARY OF THE INVENTION

The present invention overcomes the foregoing problems and other shortcomings, drawbacks, and challenges of ground testing spacecraft thermal management systems. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention a system for ground testing a spacecraft heat regulation system is provided having a spacecraft heat pipe with an upper section joined to a heat acquisition cold plate (HACP) and a lower section joined to a heat rejection cold plate (HRCP) having a length, and a bubble pump heat pipe (BPHP) having a heat acquisition riser joined to the HACP extending substantially the length of the HACP from a bottom end upward to an exit within a separator. The separator has a bottom with a heat rejection downcomer extending downward from the bottom. The separator also has a vapor condensation conduit extending from an upper vapor condensation conduit entrance within the separator to a lower vapor condensation conduit exit within a condenser. The condenser is lower than the separator and has a heat acquisition downcomer extending from a bottom end of the condenser to, and contiguous with, the heat acquisition riser. The heat rejection downcomer extends to a heat rejection pipe section joined to the HRCP and then extends to a heat rejection riser having an exit within the condenser. In operation heat is conducted from the spacecraft heat pipe upper section through the HACP into the heat acquisition riser to heat a working fluid generating vapor within the heat acquisition riser. This heated fluid now has both a buoyant vapor and heated liquid within the conduit forming the heat acquisition riser, causing a plug-slug flow with heated vapor plugs lifting heated liquid slugs. The fluid heated liquid slug and heated vapor plug exit the heat acquisition riser in the separator. The heated liquid in the separator is under pressure from the heated vapor and flows from the separator as heat rejection liquid through the heat rejection downcomer. This moves heat to the HRCP where the heat is conducted through the HRCP to the spacecraft heat pipe lower section. The heat rejection liquid then flows through the heat rejection riser and exiting into the condenser as a cooled liquid. Also, heated vapor in the separator flows through the vapor condensation conduit into the condenser and condensate liquid mixes with cooled liquid to flow through the heat acquisition downcomer to the heat acquisition riser, completing the cycle.

In a more particular embodiment, the spacecraft heat pipe is a grooved capillary wick heat pipe (GWHP). The GWHP can contain a working fluid with a sufficient charge that the heat pipe lower portion working fluid is in liquid form. The GWHP can also have deep grooves, and/or a slug length extending from the lower section through a bend substantially upwards to a slug length flange.

In another embodiment, the GWHP and the BPHP combination form a ground test spacecraft heat pipe (GTSHP) where the BPHP carries heat down and the GWHP carries heat up, enabling "test as you fly."

In another embodiment the BPHP further includes a splashguard proximate the heat acquisition riser exit and a splashguard proximate the vapor condensation inlet to prevent to prevent liquid entering the vapor condensation inlet. The BPHP can also have a divider wall extending upward from the bottom inside the condenser to prevent ingestion of vapor into the heat acquisition downcomer.

In another embodiment, the GTSHP the heat rejection pipe section has a serpentine path on the HRCP. The serpentine path can be vertically oriented.

In another embodiment the heat acquisition riser has a horizontal serpentine path in a portion joined to the HACP.

In another embodiment the GWHP has flanges mounted substantially the entire lengths of the HACP and the HRCP.

In any of these embodiments, the working fluid of the BPHP can be ammonia and the BPHP can be constructed from stainless steel or aluminum.

In another embodiment, a bubble pump heat pipe (BPHP) includes a heat acquisition riser joined to a heat acquisition cold plate (HACP) extending substantially the length of the HACP from a bottom end upward to an exit within a separator. The separator has a bottom with a heat rejection downcomer extending downward from the bottom. The separator also has a vapor condensation conduit extending from an upper vapor condensation conduit entrance within the separator to a lower vapor condensation conduit exit within a condenser. The separator also has a splashguard proximate the heat acquisition riser exit and a splashguard proximate the vapor condensation inlet to prevent to prevent liquid entering the vapor condensation inlet. The condenser is lower than the separator and has a heat acquisition downcomer extending from a bottom end of the condenser to and contiguous with the heat acquisition riser. The heat rejection downcomer extends to a heat rejection pipe section joined to a heat rejection cold plate (HRCP) and then extends to a heat rejection riser with an exit within the condenser. In operation heat is conducted from the HACP into the heat acquisition riser to heat a working fluid and generate vapor within the heat acquisition riser. This creates a plug-slug flow with a buoyant heated vapor plug lifting a heated liquid slug. The fluid heated liquid slug and heated vapor plug exit the heat acquisition riser in the separator. The heated liquid in the separator is under some pressure from the heated vapor, and flows from the separator as heat rejection liquid through the heat rejection downcomer to move heat to the HRCP. At the HRCP the heat is conducted through the HRCP to a lower temperature load. The heat rejection liquid, now cooled, flows through the heat rejection riser and exits into the condenser as a cooled liquid. The heated vapor in the separator flows through the vapor condensation conduit into the condenser and condensate liquid mixes with cooled liquid to flow through the heat acquisition downcomer to the heat acquisition riser, completing the cycle.

In a more particular embodiment, the BPHP has a divider wall extending upward from the bottom inside the condenser to prevent ingestion of vapor into the heat acquisition downcomer.

In another embodiment, the BPHP heat rejection pipe section has a serpentine path on the HRCP. The serpentine path can be vertically oriented.

In any of these BPHP embodiments, the working fluid can be ammonia. The BPHP can be constructed from many materials, including stainless steel and aluminum.

A Ground Testable Spacecraft Heat Pipe (GTSHP) can be designed to accept heat input and heat output in almost any arrangement relative to gravity. A GTSHP's performance is highly insensitive to the relative height difference between the input and output location. Other heat pipes such as Loop Heat Pipes can carry heat down, but the effort to carry the heat down comes at a substantial penalty in terms of the differential temperature across the heat pipe. GTSHP does not pay much penalty at all for moving heat further down. This makes GTSHP increasingly attractive in situations where heat must be transported more than a few meters in height. A GTSHP is very simple and cheap relative to other types of spacecraft heat pipes. GTSHP is more complicated than the simplest of heat pipes (which may cost as little as a few thousand dollars) but is far less complicated than a LHP which can cost several hundred thousand dollars to accomplish similar results. The unit cost of GTSHP may be estimated at a few ten's of thousands of dollars, at which price, GTSHP may also be cost-competitive with a GSE PFL. GTSHP can optionally leave the BPHP on the spacecraft as a vestigial artifact after test is complete. This may sound imprudent, but is actually a great feature. This feature permits the GTSHP to be installed in locations on the spacecraft that are not readily accessible after testing is complete. This saves schedule and cost and is also reduces risk because the spacecraft doesn't need to be disassembled and reassembled without the benefit of testing those reassembled connections. GTSHP can be flexibly designed to require very low heat for startup and to allow very high heat transport capacity, depending on needs. GTSHP is readily suited to solve the three example needs provided in the Background, above. GTSHP helps avoid testing in larger, more expensive thermal vacuum chambers. GTSHP can optionally be designed to achieve a desired conductance commanded by the thermal test engineer. This enables enhanced TAYF and thus reduces risk of missing a fault in the rest of the thermal system during test.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

FIG. 3A is a schematic diagram illustrating a Separator with a cross-sectional view along line A-A.

FIG. 3B is a schematic diagram illustrating the Separator of FIG. 3A at another angle with a cross-sectional view along line B-B.

FIG. 3C is a schematic diagram illustrating a Condenser with a cross-sectional view along line C-C

DETAILED DESCRIPTION OF THE INVENTION

The following description and drawings merely illustrate the principles of the invention. It will thus be appreciated that those skilled in the art will be able to devise various arrangements that, although not explicitly described or shown herein, embody the principles of the invention and are included within its scope. Furthermore, all examples recited herein are principally intended expressly to be only for illustrative purposes to aid the reader in understanding the principles of the invention and the concepts contributed by the inventor to furthering the art, and are to be construed as being without limitation to such specifically recited examples and conditions. Additionally, the term, "or," as used herein, refers to a non-exclusive or, unless otherwise indicated (e.g., "or else" or "or in the alternative"). Also, the various embodiments described herein are not necessarily mutually exclusive, as some embodiments can be combined with one or more other embodiments to form new embodiments.

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily limit any of the various claimed inventions. Moreover, some statements may apply to some inventive features but not to others. Those skilled in the art and informed by the teachings herein will realize that the invention is also applicable to various other technical areas or embodiments.

Figure 1:
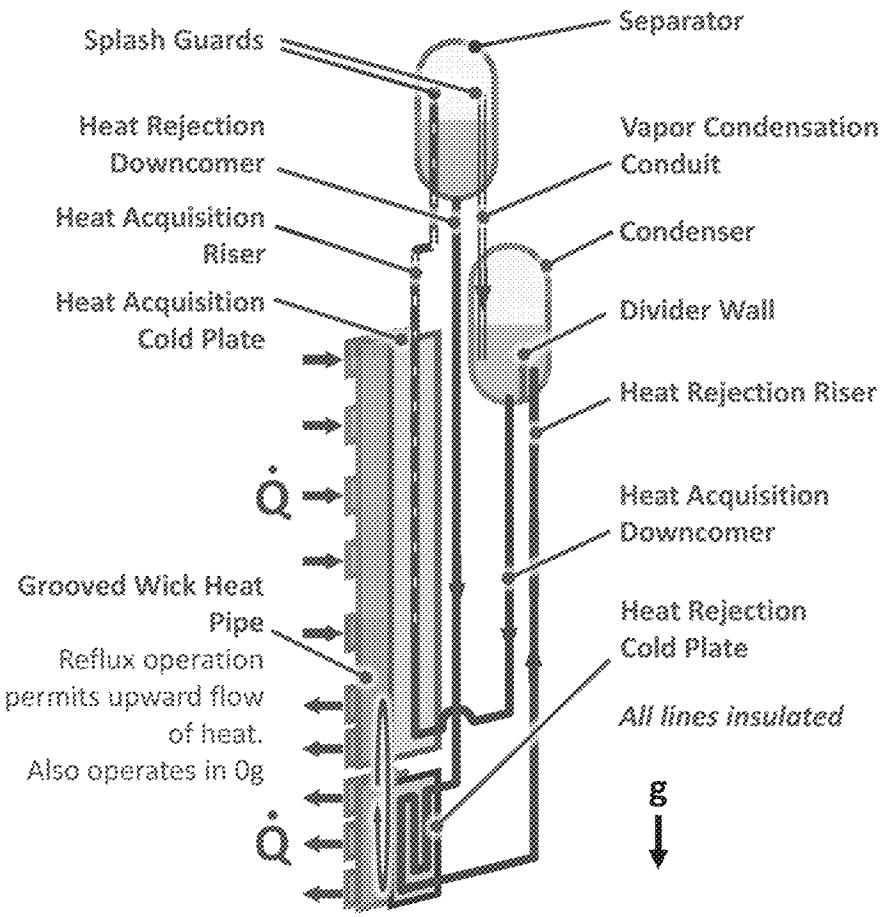
FIG. 1 is a schematic diagram showing a ground testable spacecraft heat pipe (GTSHP).
Figure 2:
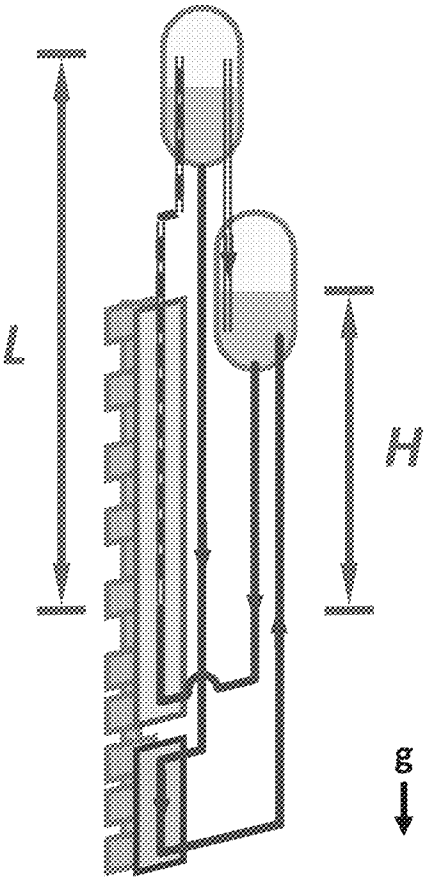
FIG. 2 is a schematic diagram of a GTSHP illustrating the Submergence Ratio
Figure 4:
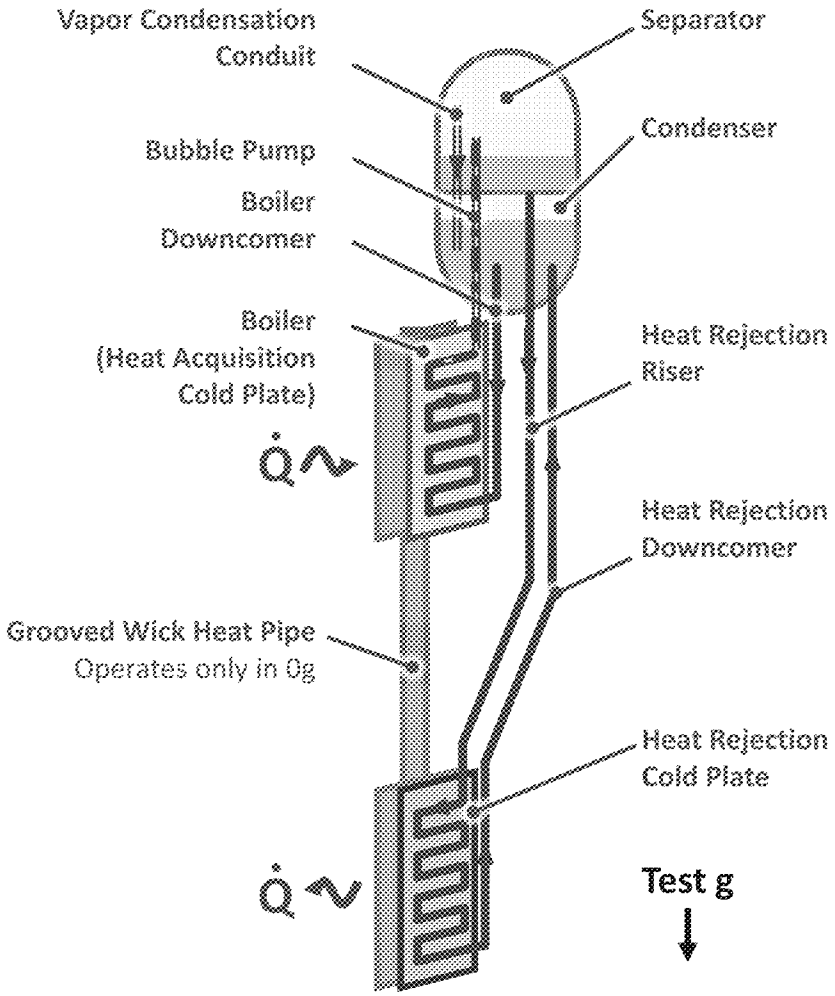
FIG. 4 is a schematic diagram illustrating another embodiment of a GTSHP It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

FIG. 1 is a schematic diagram showing a ground testable spacecraft heat pipe (GTSHP) having two separate heat pipes: a grooved wick capillary heat pipe (GWHP) and a bubble pump heat pipe (BPHP). The GWHP is a typical spacecraft heat pipe, having an Aluminum envelope, ammonia fluid, and a grooved wick.

The GWHP is similar to other typical simple spacecraft heat pipes except in the GTSHP it has enough charge to insure that the liquid puddle covers the entire Heat Rejection Cold Plate (HRCP) of the BPHP during ground test. This is necessary to insure good heat transfer from the BPHP to the GWHP. In order to achieve this puddle height, this may require the GWHP to have a larger liquid charge than typical spacecraft heat pipes. It also may require accepting a large liquid slug during space operation, in which case 'slug length' at the cold end (top during ground test) of the GWHP should be included such that the liquid slug does not block the condenser of the GWHP during flight. The GWHP might also benefit from deeper grooves to enable a greater liquid inventory in the heat pipe without having to resort to a liquid slug during flight operations. The details required to manufacture a GWHP are familiar to those skilled in the art. A GWHP can be readily procured from heat pipe manufacturers who make similar heat pipes regularly.

In the case where a liquid slug is required, the following type of slug length is proposed. Note that providing for a slug length is familiar to those skilled in the art, but some specifics to this slug length are novel. Excess liquid is not generally preferred in conventional heat pipes similar to GWHP since in space the liquid slug will tend to move to whichever end of the GWHP is cooler; the liquid slug can block part of the condenser, preventing good operation. Excess liquid happens in typical spacecraft heat pipes when operating at higher temperatures where the liquid is less dense and thus consumes more volume. 'Slug Length' is often used in these situations to provide a place for the liquid to go without blocking the heat pipe's condenser. However, the condenser location can move on a heat pipe depending on where heat is put in and taken out. This commonly happens when different electronics units are turned ON and OFF throughout spacecraft life, especially as units fail and spares are turned ON. Thus, it's not uncommon to include slug length at both ends of the heat pipe to account for all possibilities. For the GWHP, it's easy enough to put a straight slug length at the top end, but a straight slug length at the bottom end would be counterproductive because all the liquid would just puddle into the slug length rather than the region adjacent to the HRCP. A novel solution to this problem is to bend the GWHP slug length around 180 degrees and have part of the slug length stick above the HRCP during test. This way the part of the slug length above the HRCP has no liquid in it during test but does have liquid in it during flight—this enables the slug length to appropriately capture and release the fluid according to mission phase. Another thing to design for is the fact that slug length needs to have at least a slight net heat out to insure that the slug stays at that end rather than moving elsewhere in the heat pipe. This can be accomplished by attaching the end of the slug length to a cold adjacent region (e.g. a heat pipe that would be cold if the slug is at that end of the GWHP) via a flange.

The second heat pipe is the BPHP. The BPHP is substantively similar to the bubble pump cited in U.S. Pat. No. 5,351,488 to Sorenson. One main difference is that the BPHP is envisioned to use spacecraft materials and processes and is adapted for use in the space and spacecraft environment. The BPHP consists of two reservoirs, the Separator and the Condenser, and two cold plates (CPs), the Heat Acquisition Cold Plate (HACP), and the Heat Rejection Cold Plate (HRCP). The Separator is mounted above the Condenser which is in turn mounted above the HACP which is in turn mounted above the HRCP. Liquid and saturated mixture flows in a circuit from the HACP to the Separator to the HRCP to the Condenser and back to the HACP. The fluid is near saturation when it enters the HACP and the heat input there causes it to generate vapor. The size of the tubing in the HACP is a critical design element—it is sized to permit the 2-phase flow to be a plug-slug flow. This plug-slug flow is substantially homogeneous, which means the buoyant vapor plug lifts the heavy liquid slug with it as it rises. The weight of the liquid column in the downcomer from the Condenser to the bottom of the HACP is heavier than the column of saturated mixture in the HACP riser, this causes a pressure differential that drives the flow. Thus, the BPHP has the fundamental characteristic of a heat pipe—heat input drives a fluid flow. The saturated mixture in the HACP riser is lifted higher than the liquid head provided from the Condenser, thus the HACP riser and HACP downcomer work together to form a bubble pump to lift liquid to a higher elevation. The liquid head between the Separator and Condenser is now available to drive fluid flow in a circuit. Another liquid line is then routed down from the Separator to the HRCP, well below the Condenser. The liquid deposits heat sensibly in the HRCP, cooling off. The liquid then rises back to the Condenser to close the circuit. It should be noted that the vapor that enters the Separator must also be managed-if it is not routed, it would build up pressure in the Separator and create a back pressure that would effectively shutdown the BPHP (or keep it from starting in the first place). The Separator has a separate conduit, the Vapor Condensation Conduit, VCC, that routes from the top of the Separator to the bottom of the Condenser. The VCC acts to remove the latent enthalpy from the Separator and return it to the liquid in the Condenser. A simple model of the BPHP thus shows that if a thermal power, Q, goes into the HACP, that same Q is transported down the VCC where it then balances out the −Q heat that is returning to the Condenser after Q heat leaves the HRCP. Thus, Q heat travels through the BPHP, but it does it by means of transferring heat from the latent to the sensible phase in the Condenser. The genius of the Sorenson's bubble pump is that it uses a 2-phase flow to create a flow and it then converts to a 1-phase flow which is able to carry heat down-thus 2-phase and 1-phase flows are each used to do what only they can do, and the whole is greater than the sum of its parts.

The GTSHP mounting scheme is specifically designed to achieve complete testability. The BPHP is mounted to the GWHP which is mounted to the spacecraft (typically this would be other simple heat pipes that are mounted flat in test). The BPHP is a test device—it is meant to insure that the GWHP and other thermal hardware on the spacecraft can do their job in space. Thus, the BPHP needs to act as an aid to properly test that the GWHP and other space-operational hardware will work in space. The key items to be tested on the GWHP (or any other simple heat pipe) are 1) Function of the heat pipe and 2) Function of the heat pipe mounting interfaces. #1 is tested in heat pipe unit test, where the GWHP is tested flat and is fully testable. #2 above must happen in spacecraft thermal vacuum test where the GWHP is vertical and untestable on its own. Since the BPHP only receives its heat via conduction through the walls of the GWHP, the interface between the GWHP and the spacecraft is fundamentally tested whenever the BPHP is operational. This means that anomalous differential temperatures between the GWHP and the spacecraft can be detected. This may be done by mounting thermocouples on both the GWHP and the spacecraft heat pipes. The BPHP is also mounted on the outside of the stackup where it is easier to uninstall, if desired.

The means by which the GTSHP can accept and reject heat in nearly any vertical location is now described. Heat is input at any vertical location(s) on the BWHP. This generally happens where the BWHP has mounting flanges that are mounted to other flanges on spacecraft heat pipes. The quantity of thermal power applied to each of the spacecraft heat pipes will determine the heat flow into the BWHP. In situations where the BWHP is being top-heated, the BWHP will not act as a heat pipe but only as a solid thermal conductor. Usually this would be a big problem, but this invention has the HACP mounted to a flange on the other side of the BWHP. The Heat Acquisition Cold Plate (HACP) picks up the heat, moves it through the BPHP, as earlier described, and drives it down to the Heat Rejection Cold Plate (HRCP). The HRCP then conducts heat back into the BWHP, but at a lower level than before. The BWHP's liquid puddle is adjacent to the HRCP so this causes the BWHP to operate in reflux. In this way, the BWHP can transport a bit of heat up in scenarios where there is a vertical section between the HRCP and HACP that is not attached to either but is attached to spacecraft heat pipes, or even into a region adjacent to the lower part of the HACP, if that part of the HACP doesn't have a net heat flux from the spacecraft.

In situations where the length of the HACP or HRCP is not long enough to provide sufficient thermal conductance from the liquid bulk to the wall, then the flow path may be serpentined. Although both HACP and HRCP may benefit from serpentining, the HRCP is more likely to use it for at least some applications of the GTSHP since the HRCP often needs to be short relative to the HACP to insure that the HACP's height does not exceed that of the liquid pool in the GWHP.

Another reason to serpentine the HRCP is that it permits the effect of sensible cooling from beginning to end of the HRCP to be minimized. This differential temperature is part of the overall differential temperature in the GTSHP and the overall temperature should be minimized in order to allow the GTSHP to have thermal performance that is comparable to that of the GWHP in space, thus providing better test fidelity.

To accomplish this, the HRCP serpentine route should travel up and down (along the GWHP axis) to best mix the inlet and outlet temperatures of the liquid in the HRCP amongst the various heat pipes on the spacecraft that are attached to the GWHP adjacent to the HRCP.

In contrast, if serpentining of the HACP tubing is required, this should be done in a horizontal direction such that the saturated mixture is always traveling upwards (or at least horizontally) as it traverses the HACP. This insures that buoyancy is always acting to encourage the flow through the BPHP. This buoyancy aspect is not an issue in the HRCP where only liquid is present.

One area where the BPHP improves over the '488 patent is the Splash Guards and Divider Wall. The physics of the BPHP incents a narrow Separator and Condenser. This is because there is no value in having wide reservoirs. The value is in having sufficiently large reservoirs and sufficiently tall reservoirs. Thus, narrow/tall reservoirs are preferred. Reservoirs only slightly wider than the conduits at the bottom of each reservoir are expected. However, there is still a need to achieve thermodynamic equilibrium in both reservoirs. It's important that the VCC not ingest liquid and that the HA Downcomer not entrain vapor, despite the proximity of the various tubes that would tend to cause this effect. Thus, splash guards on the VCC inlet and the HA Riser outlet are proposed to keep the burbling HA riser from splurting liquid into the VCC. If the VCC ingested liquid, this would short circuit the BPHP's flow and cause unstable operation or shutdowns. For a similar purpose, a divider wall at the bottom of the Condenser is proposed to insure that all vapor from the VCC condenses in the Condenser and insures no vapor is ingested in the HA Downcomer. If the HA Downcomer ingested vapor this could have a tendency to also short circuit the heat flow through the BPHP and stop or harm the operation of the BPHP Now some discussion of Principles of Design is in order. These principles will discuss how to achieve desired outcomes with the GTSHP. The condenser elevation relative to the top of the HACP and the elevation of the Separator relative to the liquid level in the Condenser should be picked in order to balance the desire to achieve a large Submergence Ratio (SR), the desire to minimize tubing line length to minimize pressure drop, and any real estate constraints regarding how high the Separator is allowed to be above the HACP. SR is defined as the height of the liquid column delivering flow to the bottom of the bubble pump riser divided by the height of the bubble column in the riser. The bubble pump works by lifting the saturated mixture (bubble column) higher than the liquid column that drives it, so SR is always less than one. The SR is known from bubble pump literature to be a key determinant of the performance of bubble pump to deliver both flow rate and provide gravitational pressure head. In general, a higher SR enables better flow rate whereas a lower SR enable more gravitational pressure head. SR may be chosen in the design of the BPHP to balance the various competing needs.

It should be noted that the relative allocation of liquid (and thus liquid height) in the Separator and Reservoir will tend to vary depending on heat input and detailed thermo-fluidic models to predict this behavior as a function of heat input (and to a lesser degree, operating temperature) are required.

A preferred embodiment is a GTSHP that has some component of its 'heat pipe axis' (the route along which heat travels) in the vertical direction during ground test. The GTSHP consists of a BPHP mounted to a GWHP mounted to the spacecraft. In at least some operational scenarios, heat goes into the GTSHP at a higher elevation than it comes out of the GTSHP. The BWHP nominally is a standard Aluminum-ammonia grooved wick capillary heat pipe with sufficient liquid charge that the liquid pool covers the entire contact area of the HRCP with the GWHP. This may require extra liquid charge in the GWHP which may require a deeper groove geometry, a different groove geometry, or an acceptance of a liquid slug during space operation. This latter element may require a dedicated slug length of the GWHP past the end of the GWHP's attachment to other heat pipes or payloads in the spacecraft, as described earlier.

The BPHP consists of a Separator, Condenser, HACP, HRCP, and tubing to attach. The tubing in the HACP riser must be of a small enough diameter to permit the desired plug-slug flow regime. Some fraction of an inch in internal diameter is about right for ammonia, the preferred fluid. The other tubes do not have a diameter constraint and may be made larger than the HACP riser's diameter to reduce pressure drops and encourage good flow circulation (and thus good thermal performance) without requiring excess height of the BPHP above the top of the HACP to drive flow. The balance of need between these concerns and minimizing mass will determine the preferred diameter for the other tubes. A model of the BPHP has found that a tube diameter 2 to 3 times larger than that of the HACP riser is generally appropriate.

Ammonia is the preferred fluid because it has good thermal properties across the typical operational temperature spectrum and has a low freezing point that permits it to be safely used in a thermal-vacuum chamber or space. It is also the standard fluid used in spacecraft heat pipes and is well understood by manufacturers of spacecraft heat pipes.

The Separator and Condenser are preferred to be narrow and tall since there is no particular merit to being wide. The Separator and Condenser are nominally cylinders with spherical or ellipsoidal endcaps as these shapes are known to provide a good balance of manufacturability, lightness, and ability to contain pressure. The Condenser has too large diameter tubes connecting to its bottom, so the preferred embodiment is to have the two ports come in horizontally on the bottom end cap and have the bottom end cap be machined to accommodate these large ports.

Separator splash guards and a Condenser dividing wall are preferred to allow the Separator and Condenser to be narrow (and thus low volume and thus low mass) while also insuring that flows do not short circuit through the BPHP, affecting BPHP performance.

The preferred embodiment is to have flanges on both the BPHP and GWHP running the entire length of the HACP and separate similar flanges running the entire length of the HRCP. This permits efficient heat transfer between GWHP and BPHP. Note that GWHP flanges mounting to the spacecraft need only be located where the GWHP is connecting to the spacecraft (e.g. spacecraft heat pipes, electronics units, or thermal radiators). In case there are more than one discrete HACPs or HRCPs, then separate flanges can accommodate each of these.

The routing of flow through the HACP and HRCP can be routed back and forth (i.e. serpentined) if enhanced heat transfer is needed from the bulk flow in the CPs to the wall of the CPs. This is generally needed if a CP has a small contact area. If serpentining is required, the HRCP should be vertically serpentined and the HACP should be horizontally serpentined, for reasons explained earlier.

The embodiment described thus far is applicable for all anticipated applications of the GTSHP and BPHP but there are differences in preferred design elements depending upon application. In some applications, the location of heat input and heat output may vary depending on operational configuration and the GTSHP should have HACP and HRCP running essentially the whole vertical height of the BPHP. In this case, the HRCP should be tall enough to reject the required heat expeditiously but not so tall that it drives excess fluid volume requirements onto the GWHP. In other applications, the location of heat input and heat output may be more discretely known, for example if a unit or group of units requires heat to be carried down in test to an allocated thermal radiator. In this case, there may be a substantial 'adiabatic' section in between the HACP and HRCP in which the BPHP and GWHP do not have need or ability to accept or reject heat. There may also be a need to route the BPHP and GWHP laterally, not just up-and-down. This is doable and not a problem for the GTSHP. It is recommended that neither the BPHP nor the GWHP have any upward motion in the route from the HACP to the HRCP as this would act like a 'P-trap' in plumbing under a sink that would tend to catch liquid in an undesirable way. However, diagonal down and flat routing is fine.

The HACP may be oriented vertically or diagonally, the HRCP may be oriented horizontally, vertically, or diagonally.

Several alternative design approaches are feasible, thus many different materials may be used.

Bimetallic Design—Reservoirs are made of stainless steel (SS), CPs are made of Al (both plates and tubes), tubes are made of SS. Pros-great size, mass, performance, and manufacturing. Cons—delicate bimetallic transitions required at each transition point All SS design—Pros—no bimetallic transitions, great manufacturing. Cons—conduction thermal resistance through walls of CPs will drive size, mass, performance All Al design—Pros—no bimetallic transitions, great size, mass, performance. Cons—difficult bending during manufacturing. This provides good performance, doesn't require bimetallic transitions (which are challenging to use), and the manufacturing difficulties can be managed by heat pipe manufacturers The GTSHP is a fully welded design-very low risk of leaks. There is a charge tube at the top of the Separator with an optional drain tube at the bottom of HRCP to aid in assembly, integration, and test.

The GWHP is manufactured according to a procedure that is known to those skilled in the art, including heat pipe bending, heat pipe filling processes, and heat pipe sealing processes.

The BPHP is manufactured according to the following process:

- Procure Reservoirs, CPs, tubes, and charge tubes
- Bend tubes
- Weld tubes to Reservoirs and CPs
- Hydrostatic acceptance proof pressure test, drain
- Evacuate, He leak check
- Thermal-vacuum cycles until high enough vacuum reached
- If for a Thermostatic BPHP, charge with designed quantity of pressurant gas, per gas laws
- Charge with heat pipe fluid on a scale
- Vent excess fluid until design charge reached
- Pinch and seal charge port and drain—this completes manufacturing of BPHP
- Wrap all tubes and reservoirs in thermal insulation After the BPHP and GWHP are manufactured, the following steps assemble the GTSHP:

- Bolt BPHP flanges to GWHP flanges with Thermal Interface Material (TIM) in between
- Bolt GWHP flanges to spacecraft payload (likely flanges for other heat pipes that are horizontal or bottom-heated in ground test) with Thermal Interface Material (TIM) in between
- Install thermal blankets, any heaters, temp sensors, and other auxiliary hardware on GTSHP
- GTSHP assembly complete Note that different bolts and mounting holes must be used to mount the GWHP to the spacecraft and the GWHP to the BPHP. This permits a stepwise assembly and removal of the BPHP after test, if that is desired.

The GTSHP unit is tested according to the following unit test procedures for qualification and acceptance type tests:

- Qualification
- Proof pressure
- Hermeticity
- Vibration
- Thermal cycling
- Thermal Performance
- Test dT for a variety of power input quantities and locations
- Characterize ability of GTSHP to move heat down with BPHP and up with GWHP, and sometimes do both at the same time
- Characterize ability of GWHP to move heat in a flat (space-simulating) environment
- Lifetest
- Acceptance
- Proof pressure
- Hermeticity
- Aliveness or simple thermal performance Next the GTSHP is bolted to the spacecraft with another TIM and is prepared for spacecraft level test. During spacecraft level test, a GTSHP with definite heat input/output locations will start up as soon as enough heat (the startup heat) is put into the GTSHP. Note that the minimum level of heat input is determined by the design of the BPHP. In a GTSHP with indefinite heat input/output locations, the same minimum level of heat input application applies but the mode by which the GTSHP operates may be different. If heat is input in the region of the HRCP, the GWHP will operate in reflux and move heat up. If heat is input lower on the HACP then the BPHP has a good SR and will tend to have robust performance with low differential temperature across the GTSHP. If heat is applied higher up on the HACP then the SR is poorer and the differential temperature across the GTSHP suffers, at least somewhat. Again, the design of the GTSHP will determine whether this effect is problematic or not.

The GTSHP can operate in nearly any heating configuration, with the main caveat being that the BPHP cannot operate unless there is sufficient net heat into the HACP to start up the BPHP. As long as that criterion is met, then it operates.

After spacecraft thermal vacuum test (SCTV), the BPHP can be either removed from the GTSHP, leaving only the GWHP, which saves mass or the BPHP can be left on as a vestigial element that doesn't affect performance in space but also isn't worth doing the surgery to remove.

In space, the GTSHP operates only via the GWHP and the BPHP, if present, is irrelevant. If the BPHP is present then the liquid distribution throughout the BPHP is somewhat uncertain which creates uncertainty about the location of the center of gravity, which is important to designing the mass properties of the spacecraft. If this is a concern, a fluid management device (FMD) can be used, similar to a propellant management device (PMD) used in spacecraft liquid propellant tanks.

Although ammonia is the preferred fluid, other fluids can be used if there is a need for operational or survival temperatures outside ammonia's operational range of −78 to about 90 C. Such fluids include toluene on the high end and propene on the low end.

The relative heights of HACP, HRCP, and adiabatic region in BPHP can all be adjusted. The same is true for the GWHP, but in general, these lengths should match up with those of the BPHP.

Lateral routing of the BPHP is acceptable. The HACP should have some vertical component (thus, either vertical or diagonal) and the HRCP can have any orientation.

Splash guards and dividing walls are optional. Other alternatives that achieve the same goal such as dividing screen meshes are also feasible.

Designs for slug lengths are optional and previously described.

Serpentining of the flow through the CPs can be done if needed. Turbulating elements such as turbulators may be installed if the Reynolds number is too low in a given CP to enhance convection heat transfer in that CP. This may be particularly needed if a fluid with a high Prandtl number is used (i.e. a fluid that tends to be viscous but does not efficiently transfer heat, such as oils).

After test the vestigial BPHP can be removed or left as a vestigial element.

Multiple HACPs and/or HRCPs can be accommodated. If a lower HACP does not have enough heat input to start nucleating the fluid in the HACP riser, but a latter (higher) HACP does have that power, the lower HACP still receives convection heat transfer cooling from the flow that is induced by the boiling flow that starts at the higher HACP. In such cases, the lower HACP should be designed to account for the lower heat transfer coefficient through that liquid-only HACP, this might include horizontal serpentining of that HACP.

HACPs may be oriented diagonally if more HACP contact area is required (and available) than the vertical height available. Since HRCPs and liquid-only HACPs do not operate buoyantly, they do not require any vertical component at all and can be optionally horizontal.

If a BPHP is used without a GWHP, it is possible to operate that BPHP in reverse. Sizing of the CPs should take this into consideration if this is an intended operational mode. Also, of course, a BPHP without a GWHP will not work in space.

Multiple GTSHPs can be set up to function in parallel. This may be desirable in situations where a low startup heat is desired (thus driving to a low HACP riser diameter) but a high maximum transport heat is also desired (thus driving to a larger HACP riser diameter). Multiple GTSHPs with smaller HACP risers can accommodate both needs. It is known among spacecraft thermal engineers that when multiple heat pipes with startup heat are operating thermally in parallel, as in this situation, that one such heat pipe will tend to start up and suck away the superheat that might have helped start others up. There are even situations where different GTSHPs might switch off between starting and unstarting. This situation may be managed by adjusting the various GTSHPs to have slightly different performance. One way is to have more mounting thermal resistance on one than another or designing one to have a smaller HACP riser diameter which will tend to cause it to start up more easily but will need help from a more powerful GTSHP at higher powers.

Lastly, an alternative design for a Thermostatic GTSHP can enable further enhancement in Test-as-you-fly (TAYF) capability. The GTSHP can be thermostatically controlled by heating the top (vapor region) of the Separator. This is similar to a thermostatically controlled Loop Heat Pipe. A separate pressurant gas needs to be included in the system. If merely the heat pipe fluid vapor were heated, this would cause the vapor to condense in the liquid pool of the Separator and thus excessively large powers would be required in order to provide the desired performance. A separate pressurant gas will have far less solubility in the liquid heat pipe fluid. Helium is a good choice since it will buoyantly float to the top of the Separator. Temperature feedback is provided from the GTSHP's spacecraft customer (e.g. simple heat pipes mounted horizontal to gravity during test). Temp sensors at multiple locations may be required since the GTSHP's ground performance varies as a function of heat input condition, which often changes depending on the unit configuration at various points in test. A possible control algorithm: setpoint is a desired temperature difference between the controlling temp sensors on the top and bottom of the regions connected by the GTSHP. Apply heat to the top of the Separator to increase the dT between the controlling temp sensors to reach the setpoint dT.

The BPHP may be used for Solar Water Heating such as Portable, Industrial, Commercial, Residential. It should be noted that prior art of a technology from which the BPHP derives has developed a system that uses the same principles for such terrestrial applications.

Petrochemical Industry-Heat Integration, Better reliability, less downtime

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A system for ground testing a spacecraft heat regulation system comprising:

a spacecraft heat pipe with an upper section joined to a heat acquisition cold plate (HACP) and a lower section joined to a heat rejection cold plate (HRCP) having a length;

a bubble pump heat pipe (BPHP) having a heat acquisition riser joined to the HACP extending substantially the length of the HACP from a bottom end upward to an exit within a separator;

the separator having a bottom with a heat rejection downcomer extending downward from the bottom, the separator also having a vapor condensation conduit extending from an upper vapor condensation conduit entrance within the separator to a lower vapor condensation conduit exit within a condenser;

the condenser being lower than the separator and having a heat acquisition downcomer extending from a bottom end of the condenser to and contiguous with the heat acquisition riser;

the heat rejection downcomer extending to a heat rejection pipe section joined to the HRCP and then extending to a heat rejection riser having an exit within the condenser;

whereby in operation heat is conducted from the spacecraft heat pipe upper section through the HACP into the heat acquisition riser to heat a working fluid generating vapor within the heat acquisition riser creating a plug-slug flow with a buoyant heated vapor plug lifting a heated liquid slug, the fluid heated liquid slug and heated vapor plug exiting the heat acquisition riser in the separator, with the heated liquid in the separator under the heated vapor pressure flowing from the separator as heat rejection liquid through the heat rejection downcomer to move heat to the HRCP where the heat is conducted through the HRCP to the spacecraft heat pipe lower section, the heat rejection liquid then flowing through the heat rejection riser and exiting into the condenser as a cooled liquid;

further whereby in operation heated vapor in the separator flows through the vapor condensation conduit into the condenser and condensate liquid mixes with cooled liquid to flow through the heat acquisition downcomer to the heat acquisition riser.

2. The system of claim 1 wherein the spacecraft heat pipe is a grooved capillary wick heat pipe (GWHP).

3. The system of claim 2 wherein the GWHP contains a working fluid with a sufficient charge that the heat pipe lower portion working fluid is in liquid form.

4. The system of claim 3 wherein the GWHP has deep grooves.

5. The system of claim 3 wherein the GWHP has a slug length extending from the lower section through a bend substantially upwards to a slug length flange.

6. The system of claim 2 wherein the GWHP and the BPHP combination form a ground test spacecraft heat pipe (GTSHP) wherein the BPHP carries heat down and the GWHP carries heat up, enabling test as you fly.

7. The system of claim 1 wherein the BPHP further comprises a splashguard proximate the heat acquisition riser exit and a splashguard is provided proximate the vapor condensation inlet to prevent to prevent liquid entering the vapor condensation inlet.

8. The system of claim 1 wherein the BPHP further comprises a divider wall extending upward from the bottom inside the condenser to prevent ingestion of vapor into the heat acquisition downcomer.

9. The system of claim 2 further comprising the heat rejection pipe section having a serpentine path on the HRCP.

10. The system of claim 9 wherein the serpentine path is vertically oriented.

11. The system of claim 2 wherein the heat acquisition riser has a horizontal serpentine path in a portion joined to the HACP.

12. The system of claim 2 wherein the GWHP has flanges mounted the substantially the entire lengths of the HACP and the HRCP.

13. The system of claim 2 wherein the working fluid of the BPHP is ammonia.

14. The system of claim 2 wherein the BPHP is constructed from one of a stainless steel and aluminum.

* * * * *